United States Patent [19]

Cheal et al.

[11] Patent Number: 4,536,752

[45] Date of Patent: Aug. 20, 1985

[54] INTRUSION DETECTION SYSTEM AND METHOD

[75] Inventors: James Cheal; James R. Fitzsimons, both of Tempe, Ariz.

[73] Assignee: Southwest Microwave, Tempe, Ariz.

[21] Appl. No.: 454,444

[22] Filed: Dec. 29, 1982

[51] Int. Cl.[3] ..... G08B 13/18

[52] U.S. Cl. ..... 340/554; 343/5 PD

[58] Field of Search ..... 340/552, 553, 554; 367/94; 333/237; 343/5 PD, 810, 853

[56] References Cited

U.S. PATENT DOCUMENTS 4,328,487 5/1982 Cheal ..... 340/554

4,358,764 11/1982 Cheal et al. ..... 340/554

OTHER PUBLICATIONS

"A Volumetric Terrain Following Sensor", by James Cheal from the Proceedings of the 1981 Carnahan Conference on Crime Countermeasures, Lexington, KY, May 13–15, pp. 125–128.

*Primary Examiner*—James L. Rowland

*Assistant Examiner*—Jeffery A. Hofsass

*Attorney, Agent, or Firm*—Cahill, Sutton & Thomas

[57] ABSTRACT

An intrusion detection system includes a transmitter coupled to one end of a coaxial cable, a plurality of antennas spaced along and loosely coupled to the cable, and a receiver circuit coupled to the opposite end of the cable, the antennas being aimed at a protected region. The transmitter transmits microwave energy along the cable. A portion of the energy is transmitted by each antenna into the protected region and is reflected by a moving intruder or target back to one of the antennas. The receiver circuit imposes a low frequency square wave signal on the center conductor of the cable. A diode is attached across the two radiating elements of each antenna. The square wave on the center conductor forward biases the diode and thereby shorts each antenna for half of each low frequency cycle, resulting in chopping of the received signals from each antenna. Noise signals on the cable and the chopped received energy signals are filtered and mixed to produce a low frequency chopped doppler signal superimposed on the noise low frequency chopped doppler signal. The signal is amplified to a predetermined level, and adjacent maximums and minimums thereof are synchronously sampled by a doppler amplifier to produce a signal representative of the amplitude of the doppler signal.

18 Claims, 8 Drawing Figures

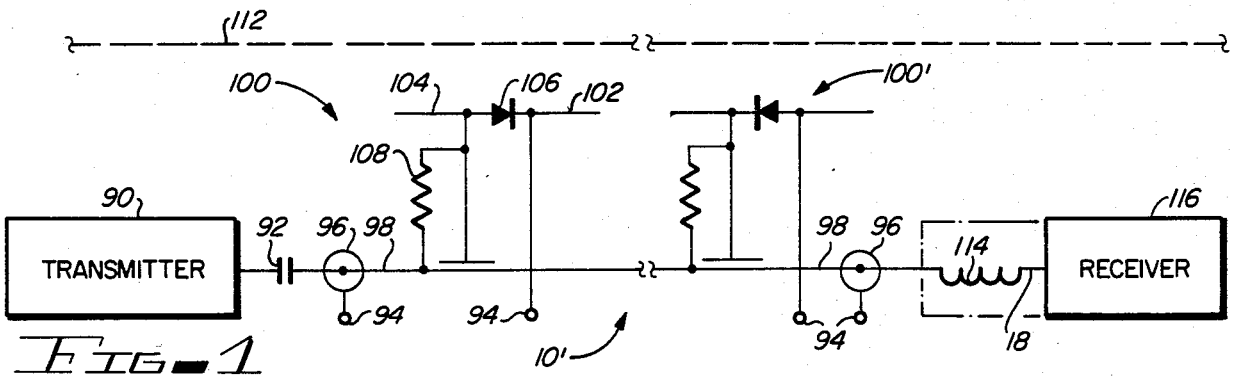
FIG. 1
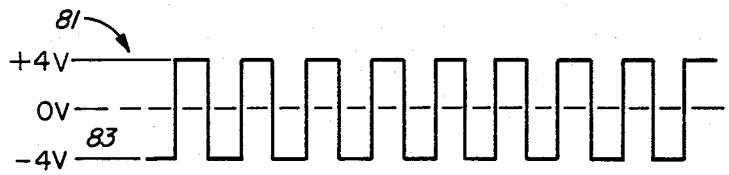
FIG. 1A
FIG. 2
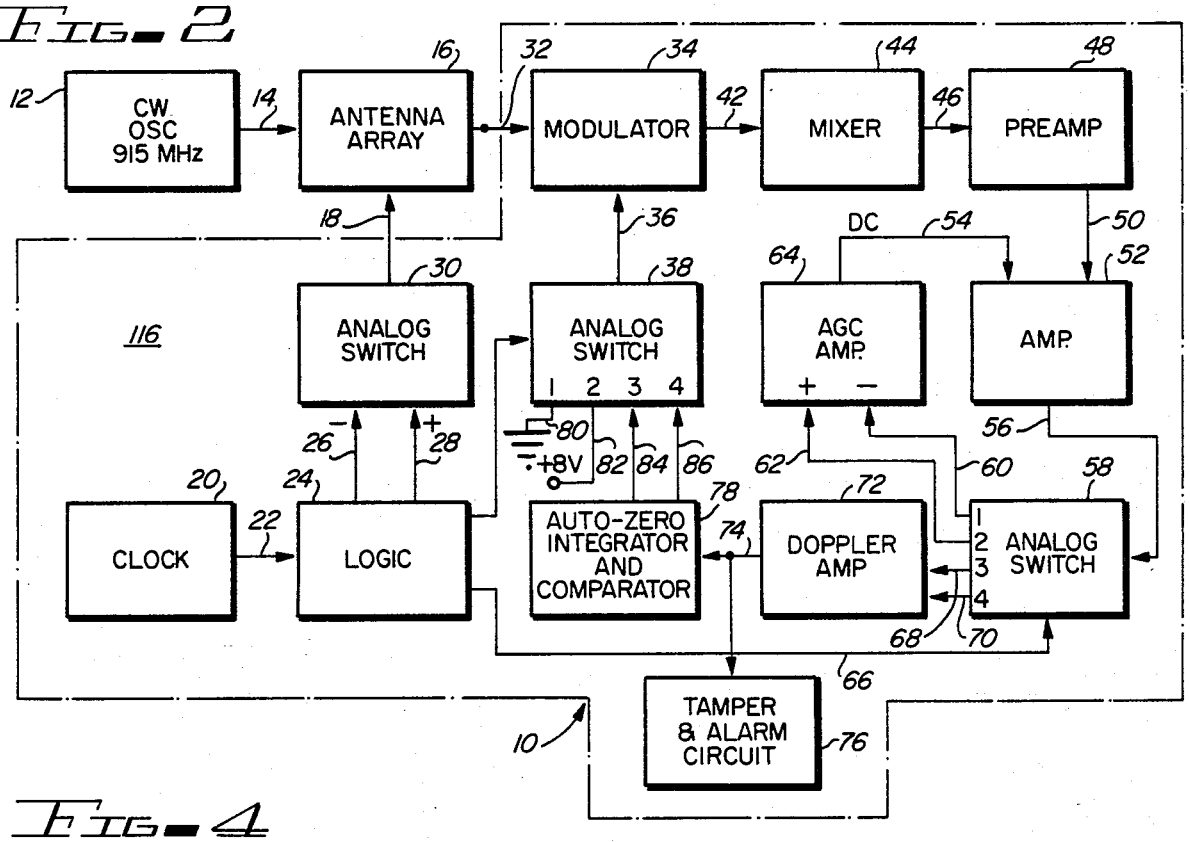
FIG. 4
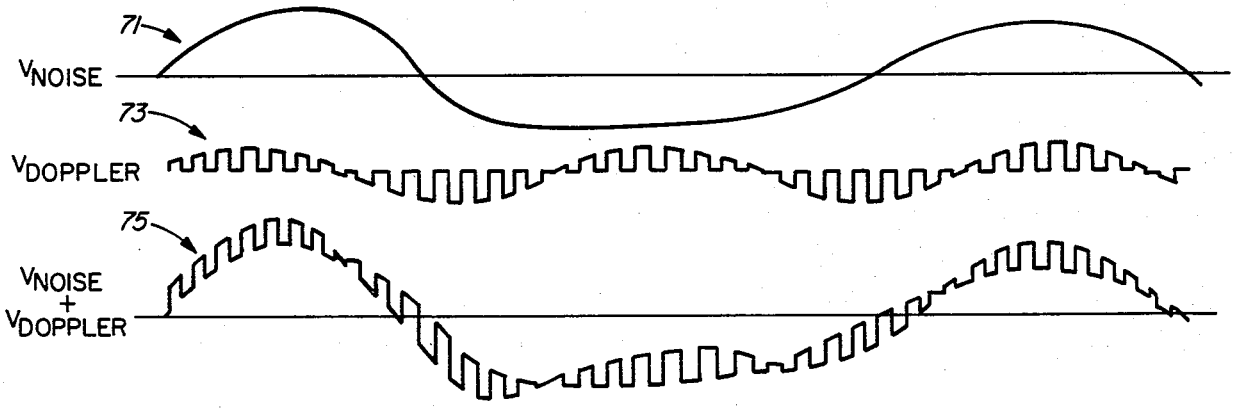

TIME FRAME
0 1 2 3 4 12 13 14 15 0 1 2
118
119
120
MIXER
MODULATOR
46
42
34
36
E8
E11
32
30
2.7K
1μf
10 K
10μf
1K
220μf
38
10K
10 K
10 K
10 K
100K
LM 358
78
22M
MC 34002
100 K
10μf
72B
1μf
.1
10K
68 K
1K
10 K
22 M
FROM FIG. 3B
10 μf
249
1.33 K
124
LM317LZ
10μf
10μf

INTRUSION DETECTION SYSTEM AND METHOD

BACKGROUND OF THE INVENTION

The invention relates to microwave intrusion detection systems, especially to improvements which increase the signal to noise ratio thereof and reduce the likelihood of false alarms.

Perimeter intrusion detection systems, such as those described in U.S. Pat. Nos. 4,328,487 and 4,358,764, which are assigned to the present assignee and are incorporated herein by reference, are finding increased application. Such systems are often used in connection with a fence or wall that bounds the area to be protected. The types of systems include a coaxial cable or transmission line with a microwave frequency transmitter at one end and a receiver at the other end and a plurality of spaced antennas loosely coupled to the cable and aimed into the protected region. This type of system is especially useful in irregular terrain because the cable and antennas can follow the contours of the terrain. One of the disadvantages of prior systems of this type is that the target reflection signal is very small compared to the reference signal that is received by the receiver via the cable or transmission line. Noise generated by the oscillator and noise generated by the connectors due to forces, such as wind forces, on the transmission line falls within the doppler pass band and often results in false alarms. The target reflection signal is very small relative to the reference signal because the entire microwave signal, typically approximately 915 megahertz, transmitted along the cable by the transmitter is modulated at a roughly 10 to 50 kilohertz rate and only a small proportion of the microwave signal energy is transmitted by a particular antenna, and still less is reflected.back from a moving target and coupled back onto the cable. (Such modulation or chopping of the carrier signal is done in order to avoid the 1/f low frequency noise amplification problems that would otherwise be encountered, as those skilled in the art will recognize). Thus, it is very difficult to recover the doppler frequency signal due to the very low signal to noise ratio.

Therefore, it can be seen that there is an unmet need for an intrusion detection system and method of the above-described type which avoids false alarms due to noise generated by the transmitter and by the connectors due to wind forces on the transmission line.

Accordingly, it is an object of the invention to provide an improved microwave intrusion detection system including a plurality of antennas loosely coupled along a transmission line wherein reflected signals from targets within the protected region, received by the antennas and conducted along the transmission line to a receiver, are reliably detected despite the presence of a relatively high level of connector noise in the doppler pass band.

It is another object of the invention to provide relatively inexpensive circuitry in a microwave intrusion detection system which reliably detects moving targets in the protected region despite the presence of a relatively high level of connector noise and/or transmitter noise in the doppler pass band.

SUMMARY OF THE INVENTION

Briefly described and in accordance with one embodiment thereof, the invention provides an improved intrusion detection system and method including circuitry for transmitting a continuous high frequency signal on a cable disposed along the periphery of a protected region, loosely coupling high frequency energy from the cable to each of a plurality of antennas spaced along the cable, periodically interrupting the reception of high frequency energy reflected from a moving target in the protected region and received by an antenna to produce a chopped signal on the cable (the cable also conducting a relatively large noise signal in the doppler pass band), mixing the noise signal and the chopped high frequency signal to produce a signal that includes doppler signals representing movement of the target, determining the amplitude of the doppler frequency signal by synchronously sampling adjacent minimum and maximum potentials of the mixed signal, and generating an alarm signal if the detected amplitude of the doppler frequency signal exceeds a predetermined threshold.

In the described embodiment of the invention, a microwave oscillator is coupled to one end of a coaxial cable along which from 1 to 33 uniformly spaced antennas aimed into the protected region are loosely coupled to the coaxial cable. The dipole elements of each antenna are respectively connected to the anode and cathode of a diode. The loosely coupled dipole is connected by means of a resistor to the center conductor of the cable. A receiver circuit is coupled to the other end of the cable by means of a radio frequency choke. The receiver circuit produces a 24 kilohertz square wave pulse on the center conductor. The 24 kilohertz square wave is symmetrically centered about the voltage of the outer conductor of the cable, causing the respective diodes to short circuit the dipole elements of each antenna during half of each cycle, thereby modulating the microwave energy transmitted and received by each antenna. The signals received from the center conductor of the antenna are periodically attenuated by one decibel to produce a periodic 3 KHz reference pulse by means of which amplification of the doppler signals can be accurately automatically calibrated. The attenuation is produced by means of a PIN diode which functions as a voltage variable attenuator to couple a controlled amount of the microwave signal from the center conductor of the cable to the outer conductor thereof. The controlled voltage of the voltage variable attenuator is generated in response to a logic circuit subsequently described. Using the same voltage variable attenuator, cancellation signals derived from residual noise and background signals received from the center conductor of the coaxial cable are synchronously applied thereto. The resulting signals with the reference pulses and cancellation signals imposed thereon, are input to a mixer including a resonant cavity to eliminate the microwave frequency components of the signal and a detection diode to produce a detected signal which includes a chopped doppler frequency signal superimposed upon the noise signal, which is within the doppler frequency pass band of the system. This detected signal is amplified by a first preamplifier and fed into another second amplifier, the gain of which is automatically adjusted in response to an automatic gain control circuit that monitors the amplitude of the reference pulse of the output of the second amplifier. The gain of the second amplifier is adjusted to cause the amplitude of the reference pulse to have a predetermined value. The output of the second amplifier is alternately switched in response to the logic circuitry to cause the positive and negative inputs of a doppler amplifier to simple adjacent relative maximums and minimums of the detected, gain-adjusted signal to produce a DC signal or slowly varying doppler signal representing the amplitude of any doppler frequency signal components produced in response to the moving target. If the output of the doppler amplifier is within a predetermined comparator window, an alarm circuit is actuated. Any components in a doppler amplifier signal having time constants exceeding a predetermined time constant are integrated by an auto-zero integrator circuit. CMOS analog switches and bi-polar transistor analog switches are utilized to switch the second amplifier output to the automatic gain control amplifier inputs and, to the doppler amplifier inputs during the appropriate time frames determined by the logic circuitry to apply the 24 kilohertz "antenna modulation" signal to the center conductor of the coaxial cable and to control the voltage controlled attenuator. The high signal to noise ratio of the detected signal achieved by the above circuitry greatly reduces the probability of false alarms over the closest prior art.

BRIEF DESCRIPTION OF THE DRAWINGS

FIG. 1 is a schematic diagram illustrating the intrusion detection system of the present invention.

FIG. 1A is a diagram of a low frequency signal imposed by the receiver on the center conductor of the cable of FIG. 1.

FIG. 2 is a block diagram illustrating the main sections of the transmitter and receiver of FIG. 1.

FIG. 4 is a diagram illustrating waveforms that are useful in explaining the operation of the block diagram of FIG. 2.

DESCRIPTION OF THE INVENTION

Figure 3A:
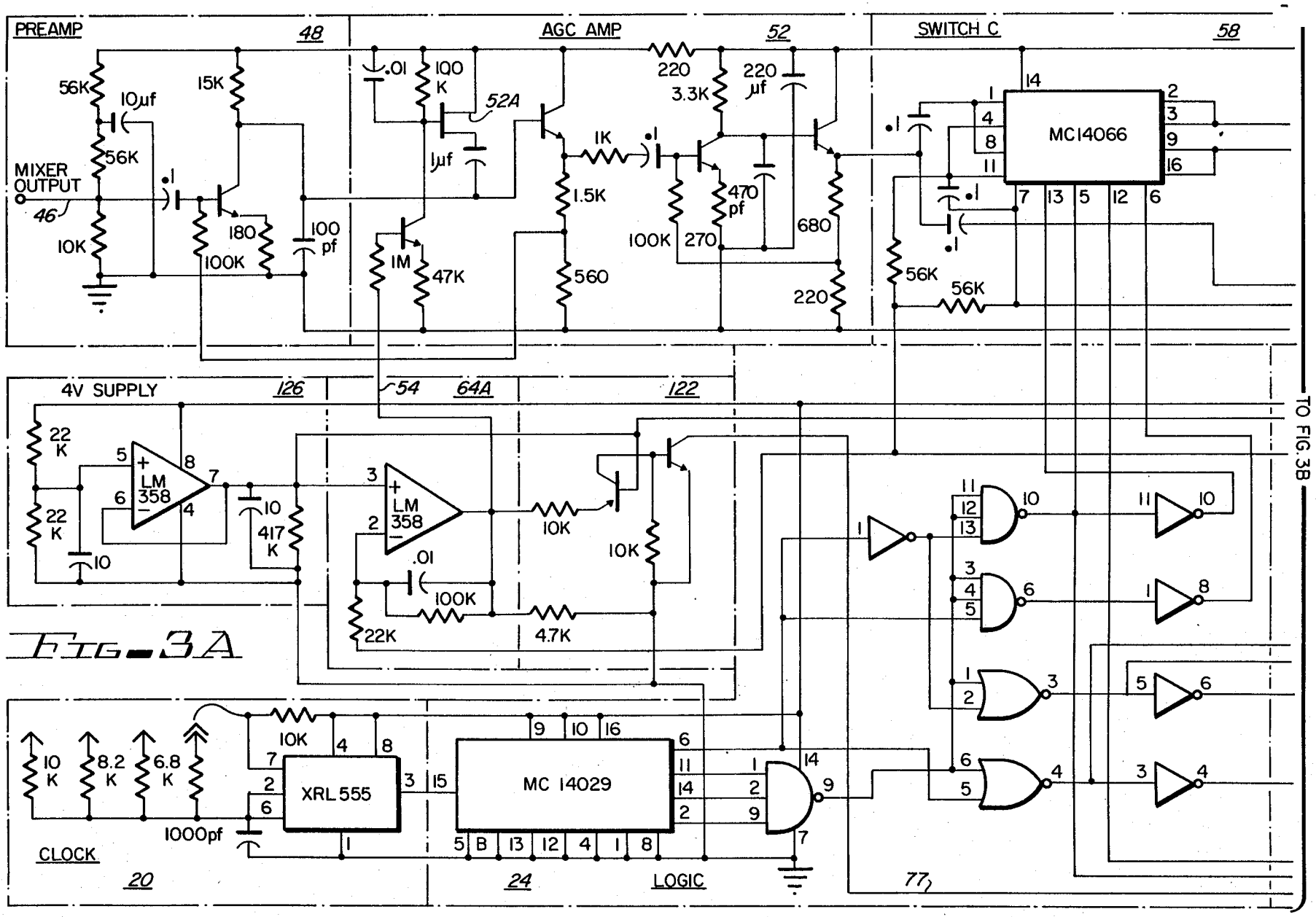
FIGS. 3A–3C constitute a detailed circuit schematic diagram of the receiver of FIG. 1.

Referring now to FIG. 1, intrusion detection system 10' includes a transmitter 90 which generates a 915 megahertz continuous wave (CW) carrier that is applied by blocking capacitor 92 to the center conductor 98 of a coaxial cable. Reference numeral 96 represents the outer conductor of the cable, which is connected to conductor 94, which is held at a reference voltage of zero volts. Typically, the cable may be approximately 100 meters in length, and may have coupled thereto a plurality of antennas such as 100 and 100' including dipole radiating elements such as 102 and 104, spaced along the cable approximately every 10 feet. The antennas are "loosely" coupled to the cable so that only a small percentage of the microwave energy of the 915 megahertz signal is coupled to each antenna. At the opposite end of center conductor 98 a radio frequency choke (RFC) 114 connects inner conductor 98 to circuitry, subsequently described, in receiver circuitry 116. Dotted line 112 represents a fence or a wall bounding the protected area into which the antennas 100 and 100' are aimed. For more detailed information on the structures of the antennas and cable connectors that can be used, see U.S. Pat. No. 4,328,487 issued May 4, 1982, filed July 28, 1980, by James Cheal, and U.S. Pat. No. 4,358,764 issued Nov. 9, 1982, filed July 28, 1980 by James Cheal and Vincent J. McHenry, both assigned to the present assignee, and both incorporated hereby by reference.

Still referring to FIG. 1, each antenna unit 100 and 100' is a YAGI three element antenna that includes two radiating elements 102 and 104. Dipole element 102 is connected to the conductor of the cable, and also to the cathode of a switching diode 106. Dipole element 104 is connected to a coupling plate in the connector by means of which antenna unit 100 is loosely coupled to the cable. A resistor 108 is connected between center conductor 98 and one end of dipole element 104 to allow low frequency switching of the diodes such as 106. In alternate antennas, the directions of the switching diodes are reversed, so that only approximately half of the antennas are shorted out during each half cycle of waveform 81 of FIG. 1A. This avoids large changes in the VSWR (voltage standing wave ratio) in the coax cable which would, in effect, generate yet another undesirable source of noise in the system.

At this point, it will be helpful to describe the structure and operation of the block diagram of FIG. 2. Referring now to FIG. 2, oscillator 12 is the main operative element in transmitter 90 (FIG. 1). It produces a constant amplitude, continuous frequency signal of 915 megahertz and couples the signal via blocking capacitor 92 (FIG. 1) to conductor 14 (FIG. 2). Conductor 14 of FIG. 2 can be thought of as one end of the cable including center conductor 98 in FIG. 1. The microwave signal level at the input end of cable 98 is approximately +17 dbm. Cable 98 has an impedance of 75 ohms in the described embodiment of this invention.

Block 16 of FIG. 2 schematically represents the entire antenna array distributed along the cable 98 in FIG. 1 and cable 98 itself. Line 18 in FIG. 2 represents the connection of receiver 116 to center conductor 98 by means of which a 24 KHz square wave signal 81 (FIG. 1A) having a maximum value of +4 volts and a minimum value of −4 volts is applied to center conductor 98 by receiver 116. The outside shield conductor of cable 98 is at zero volts, causing the diodes such as 106 of alternately positioned antennas to be forward biased, or "shorted out" for half of each 12 KHz cycle. This modulates the radiation transmitted from and received by the antennas 100 and 100'.

Figures 3C, 5:
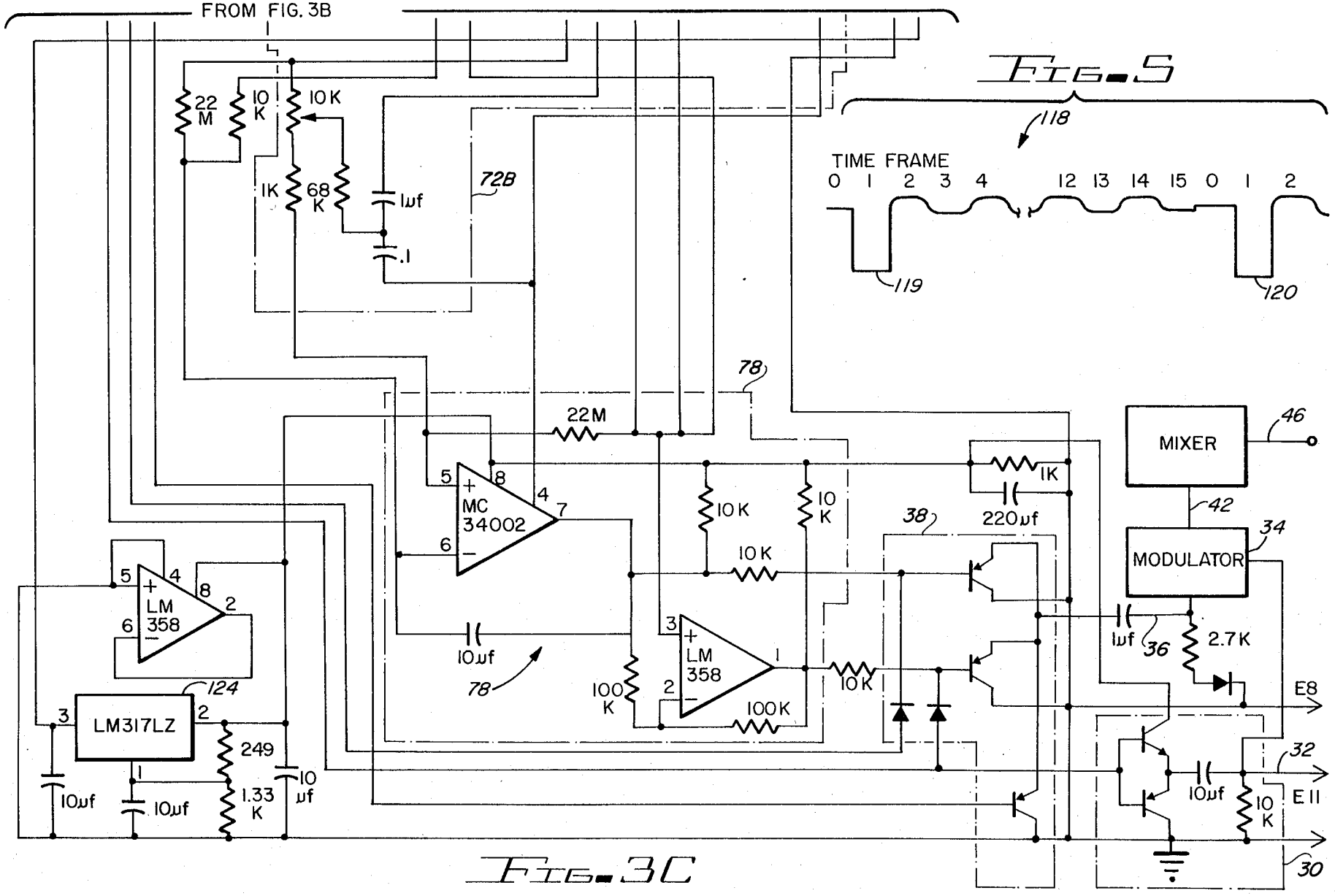
FIG. 5 is a diagram of another waveform that is useful in explaining the operation of the invention.

Reference numeral 32 in FIG. 2 represents an internal connection in receiver 116 from center conductor 98 into a voltage controlled attenuator 34. Voltage controlled attenuator 34 can be implemented by means of a PIN diode that is contained in a standard microwave coupler component. Depending upon the voltage applied to its control element, voltage controlled attenuator 34 attenuates the microwave signals received from center conductor 98 by shunting a portion of such microwave signals from center conductor 98 to the outer conductor of the coax cable. Voltage controlled attenuator 34 can be implemented by means of a Hewlett Packard HP5082-3080 PIN current controlled resistor. Attenuator or modulator 34 selectively inserts one decibel of attenuation at certain times, (time frames 0 and 1 in Table 1) to provide self calibration of the automatic gain control circuit, subsequently described. Voltage controlled attenuator or modulator circuit 34 also imposes cancellation signals which are equal but opposite in polarity to residual noise signals present on center conductor 98 and due to various causes, including mechanically induced connector noise signals and very slow doppler frequency components reflected from stationary targets in the protected region. These cancellation signals are imposed by means of voltage controlled attenuator and analog switch circuit 38 during time frames 2–15 of Table 1. In FIG. 5, waveform 118 illustrates an enlarged sample of a portion of waveform 75 of FIG. 4, and pulses 119 and 120 represent the reference pulses of the detected signal that emerges from mixer 44. Pulses 119 and 120 result from the above one db attenuation applied during time frames 0 and 1.

The signals on conductor 32, modulated by circuit 34, appear on conductor 42 and are fed into a mixer 44, which includes a tuned cavity and a diode mixer circuit that detects the doppler frequency contained in the incoming signals. The tuned cavity can be implemented by a coaxial cavity and a Southwest Microwave part number 02B12104-A01 detector cover assembly and the diode of the mixer can be a Hewlett Packard part number HP IN2787 connected in a conventional manner between the terminals of the resonant cavity. The mixer output signal on conductor 46 will contain chopped doppler frequency components with a frequency of $2V/\lambda$ where V is the velocity of the moving target and $\lambda$ is the wavelength of the reflected microwave energy.

Preamplifier 48 simply amplifies the detected doppler signals on conductor 46 to a convenient initial level and conducts them via conductor 50 to an input of amplifier 52. The gain of amplifier 52 is automatically adjusted during the first two frames of each 16 state cycle of logic circuitry 24, subsequently described. The above-mentioned one decibel attenuation reference pulse during the first two time frames generated by logic circuit 24 is sampled by inputs to 60 and 62 of automatic gain control (AGC) amplifier 64 in response to analog switch circuitry 58 to automatically calibrate the gain of amplifier 52. Thus, regardless of the length of coax cable 98 and the number of antennas that are coupled thereto, and regardless of the other attenuation in the path of the microwave signals, the gain of amplifier 52 is always automatically adjusted so that there is a proper amount of attenuation in the signal path up to the input of doppler amplifier 72.

As an example of the noise signals that may be present on center conductor 98 of the cable, see $V_{noise}$ waveform 71 of FIG. 4. This signal may have a frequency in the doppler pass band of one half hertz to 20 hertz, and may have a signal level in the range of −70 dbc to −90 dbc at the input to mixer 44. The modulated doppler frequency signals produced by reflection from a moving target or intruder in the protected region, such as the $V_{DOPPLER}$ waveform 73 in FIG. 4 may have signal levels in the range of −70 dbc to −90 dbc. Thus, the target or intruder signal to be detected may be many times smaller than the noise signals in the doppler pass band, for example, if $V_{DOPPLER}$ waveform 73 has a signal level of −90 dbc and the $V_{NOISE}$ signal 71 has a signal level of −70 dbc. This situation causes the considerable difficulty experienced by prior art intrusion detection systems in economically and reliably detecting significant intruders without setting off false alarms.

The two waveforms 71 and 73 are mixed by mixer circuit 44 to eliminate the microwave signal components and produce a "detected" signal at the output of mixer 44 having a general appearance such as that of waveform 75 in FIG. 4.

Analog switch 58, in response to logic circuitry 24, alternately switches signal of waveform 75, after amplification thereof by amplifier 52, onto the positive and negative inputs 70 and 68 of doppler amplifier 72 during time frames 2–15 of Table 1. Doppler amplifier 72 is essentially a difference amplifier with a doppler band filter. The signal level is temporarily stored on, and hence coupled by each of conductors 68 and 70 as the signal is switched to the other conductor. The switching is in synchronization with the pulses shown in waveform 75, and therefore, the common mode noise represented by waveform 71 is eliminated. The difference between the sampled adjacent maximum and minimum potentials of the amplified version of waveform 75 then is amplified by doppler amplifier 72, effectively subtracting the common mode noise $V_{noise}$ and the output of the doppler amplifier 74 represents the amplitude of the "envelope" of the dopper frequency waveform 73. If this amplitude, the frequency of which varies in the range from roughly one-half cycle per second to twenty cycles per second, exceeds a predetermined threshold, an alarm circuit 76 is triggered.

At this point, it will be helpful to describe in more detail the operation of the logic circuitry 24 what has been referred to above as generating the time frames of Table 1. Logic circuitry is clocked by clock circuit 20 in FIG. 2, which operates to produce a 48 kilohertz pulse on conductor 22. This 48 kilohertz signal is input to logic circuitry 24. Logic circuitry 24 includes a binary four bit counter that repetitively counts the 16 consecutive states which correspond to time frames 0–15. During the time frame 0, logic circuit 24 causes the zero volt signal of conductor 80 to be applied to attenuator control conductor 36 by means of analog switch 38. During time frame 1, logic circuit 24 causes the 8 volt signal on conductor 82 to be applied to attenuator control conductor 36. During time frames 2–15, logic circuit 24 alternately causes −4 volt and +4 volt signals to be applied by means of analog switch 30 to center conductor 98 of the cable shown in FIG. 1. Conductor 18 is the output of analog switch 30.

During time frames 2–15, the output of auto-zero integrator and comparator circuitry 78 are applied alternately to attenuator control conductor 36. During time frames 2–15, analog switch 58 alternately applies the amplified detected signal on output conductor 56 of amplifier 52 to the positive and negative inputs of doppler amplifier 72. As previously mentioned, during the time frames 0 and 1, the output of amplifier 52 is alternately connected to the negative and positive inputs of AGC amplifier 64 to thereby close the AGC loop and properly adjust the gain of amplifier 52.

It should be noted that the "states" of analog switch 30 are labeled in FIG. 2 as 1 and 2, adjacent to the input conductor, the voltage of which is coupled to the analog switch output during that state. Similarly, the states of analog switch 38 are labeled 1, 2, 3, and 4. Finally, the states of analog switch 58 are labeled 1, 2, 3, and 4. The indicated states for each analog switch occur during the time frames (generated by the 16 bit binary counter in logic circuitry 24) indicated in Table 1. The reader should recognize that the lines running from logic circuit 24 do not necessarily represent individual conductors. Instead, they represent conductors or groups of conductors necessary to cause the following operation, i.e., they represent decoded enable signals that are applied during the appropriate time frames to the various analog switch control inputs to implement the operation indicated in Table 1, shown below.

TABLE 1

| TIME FRAME | STATE OF SWITCH 30 | STATE OF SWITCH 38 | STATE OF SWITCH 58 |
|---|---|---|---|
| 0 | 2 | 1 | 1 |
| 1 | 2 | 2 | 2 |

TABLE 1-continued

| TIME FRAME | STATE OF SWITCH 30 | STATE OF SWITCH 38 | STATE OF SWITCH 58 |
|---|---|---|---|
| 2 | 1 | 4 | 4 |
| 3 | 2 | 3 | 3 |
| 4 | 1 | 4 | 4 |
| 5 | 2 | 3 | 3 |
| 6 | 1 | 4 | 4 |
| 7 | 2 | 3 | 3 |
| 8 | 1 | 4 | 4 |
| 9 | 2 | 3 | 3 |
| 10 | 1 | 4 | 4 |
| 11 | 2 | 3 | 3 |
| 12 | 1 | 4 | 4 |
| 13 | 2 | 3 | 3 |
| 14 | 1 | 4 | 4 |
| 15 | 2 | 3 | 3 |

Figure 3B:
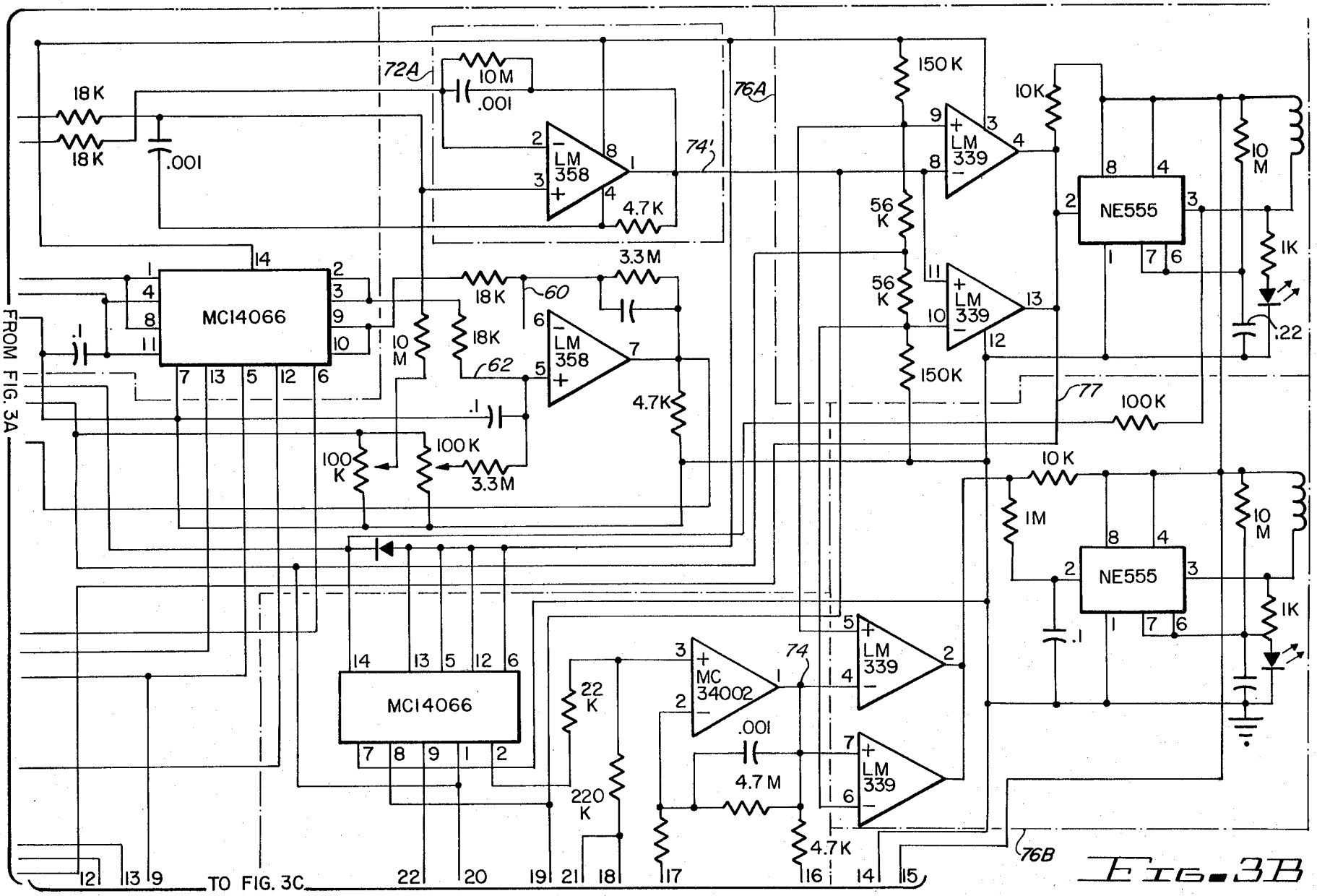

The circuitry in the blocks illustrated in FIG. 2 can be readily implemented by those skilled in the art. However, our present implementation is shown in the detailed circuit schematic diagram of FIGS. 3A–3C. In FIGS. 3A–3C, the well known manufacturer's part numbers of the various integrated circuit components are indicated. Also, the manufacturer's lead numbers have been indicated for convenience to a reader who may wish to implement precisely the circuit shown. Resistor values such as 22 M, 10 K, etc. designating 22 megohms and 10 kilohms, respectively, are indicated beside resistors and capacitance values such as one $\mu$f, indicating one microfarad, appear beside capacitors. Subsections of the circuitry shown in FIGS. 3A–3C are encircled by dotted lines designated by reference numerals that are identical to or similar to the blocks indicated by the same reference numeral in FIG. 2. (Where use of identical reference numerals is impractical, additional letters have been added to the reference numerals to indicate correspondence.) Similarly, identical or similar reference numerals indicate corresponding conductors in FIGS. 2 and FIGS. 3A–3C.

Referring now to FIG. 3C, analog switch 30 includes an NPN transistor and PNP transistor connected in a push-pull configuration to conductor 32 by a 10 microfarad capacitor. Conductor 32 is coupled by an RFC choke to cable center conductor 98. Analog switch 38 is composed of three PNP transistors with collectors connected to ground and emitters wire ORed together and capacitively coupled to control input 36 of voltage controlled attenuator 34. Analog switch 58 includes two CMOS MC14066 integrated circuit analog switches. The control inputs of the three analog switches 30, 38 and 58, are connected to the outputs of a plurality of logic gates contained in logic circuitry 24. These logic gates decode the binary outputs of a CMOS MC14029 integrated circuit binary counter, which is clocked by clock circuit 20. Clock circuit 20 contains a conventional 555 integrated circuit timer connected as an astable multivibrator, the frequency of which is controlled by a 1,000 picofarad capacitor and one of four selectable resistors.

Preamplifier 48 includes a simple one transistor amplifier circuit, as shown in FIG. 3A. Amplifier 52 is a more complicated circuit, the gain of which is controlled by a junction field effect transistor 52A. The gate electrode of field effect transistor is controlled in response to a comparator 64A contained in AGC amplifier 64. The first stage of AGC amplifier 64 includes a differential input circuit designated by reference numeral 64B in FIG. 3A. Doppler amplifier 72 includes an LM358 operational amplifier and associated circuitry as indicated in reference numeral 72A in FIG. 3B. Doppler amplifier 72 also includes a doppler filter designated by reference numeral 72B in FIG. 3A. The doppler amplifier eliminates frequencies beyond the lower and upper ends of the doppler passband before applying the output signal on conductor 74 to the input of a comparator window formed by circuitry 76A. Circuitry 76A which includes an alarm relay hold circuit. The signal 74' in FIG. 3A connected to the output of the amplifier stage 72A of doppler amplifier 72 is connected to the input of a tamper window comparator circuit 76B. Circuit 76B also includes an output relay circuit. The signal on conductor 77 is generated in response to a loss of the 915 megahertz carrier signal. This condition is detected by the circuitry designated by reference numeral 122 in FIG. 3C. The four volt and eight volt supply voltages are generated by the circuits designated by reference numerals 126 and 124, respectively, in FIGS. 3A and 3C, respectively.

Reference numeral 78 in FIG. 3C designates the autozero integrator and comparator stage, which is implemented by an MC34002 integrated circuit and a phase inverter circuit implemented by means of an LM358 integrated circuit operational amplifier in FIG. 3C.

While the invention has been described with reference to a particular presently preferred embodiment thereof those skilled in the art will be able to make various modifications to the disclosed embodiment of the invention without departing from the true spirit and scope thereof. Moreover, it is intended that all elements and method steps which accomplish substantially the same function in substantially the same way to obtain substantially the same results be encompassed within the scope of the invention. For example, the described embodiment of the invention imposes the 24 kilohertz antenna modulation signal from the receiver end of the cable. However, what is really important is that the reflected signals from the moving target have chopped form and that the noise signals in the doppler pass band not be chopped, so that noise within the doppler pass band can be eliminated as common mode noise at the input of doppler amplifier. This objective can be achieved with various doppler amplifier circuit configurations other than the one disclosed herein. Although it is convenient to generate the chopping signal in the receiver circuit, since the other switching operations need to be synchronized therewith, the antenna modulation signal could instead be applied at the transmitter end of the cable, and synchronization information could be recovered by appropriate detection circuitry in the receiver circuitry. If separate antennas are used for transmitting and receiving, techniques could be utilized to chop only the receive signals.

We claim:

1. A method for detecting intrusions into a protected region, said method comprising the steps of:

(a) transmitting a microwave signal along a cable bounding said protected region;

(b) coupling relatively small portions of said microwave signal into each of a plurality antennas to effect radiating microwave energy from said antennas into said protected regions;

(c) periodically causing interrupting of microwave energy that is received by radiating elements of each of said respective antennas at a frequency that is greatly lower than the frequency of said microwave signal in order to produce a first signal which is a chopped microwave signal on said cable, said cable also conducting a noise signal that is within the doppler frequency range of a moving target in said protected area;

(d) filtering microwave frequencies from said first signal and mixing said filtered first signal with said noise signal to produce a second signal, said second signal including a sequence of pulses that represent said first signal and are superimposed on said noise signal;

(e) producing a signal representative of the amplitudes of said pulses of said sequence by comparing the potentials of said second signal before and during a plurality of said pulses, respectively; and (f) producing an alarm signal.

2. The method of claim 1 wherein said cable is a coaxial cable and each of said antennas includes first and second radiating elements, each of said antennas includes a diode coupled between its first and second radiating elements, and also including means for connecting one of said first and second radiating elements to the outer conductor of said coaxial cable and also including resistive means for coupling the other of said first and second radiating elements to the center conductor of said coaxial cable, said step of periodically causing said interrupting including applying a relatively low frequency pulse signal to said center conductor of said cable to periodically forward bias each of said diodes and thereby effectively short circuit said first and second radiating elements of each of said antennas.

3. The method of claim 1 including the step causing periodic insertion of a predetermined amount of attenuation in the path of said first signal to cause calibration pulses during which said first signal has reduced amplitude to appear in said second signal and amplifying said second signal by means of an automatic gain control circuit which amplifies said second signal by an amount necessary to cause said calibration pulses to have a predetermihed amplitude, thereby automatically compensating for variations in insertion loss due to use of various lengths of said cable and various numbers of said antennas loosely coupled thereby which may be utilized to bound various sized protected regions.

4. The amplitude of claim 3 including the step of integrating any changes in the amplitude of said signal representative of the amplitudes of said pulses, if the frequency of those changes are very slow compared to any doppler frequency signals produced by said moving target, in order to produce a cancellation voltage signal and in response thereto producing a cancellation signal component on a conductor conducting said first signal and said noise signal prior to said filtering and said mixing.

5. The method of claim 4 wherein said calibration pulses and said cancellation signal component are produced at different times by multiplexing a first reference voltage and said cancellation voltage signal to a control input of a voltage controlled attenuator.

6. The method of claim 1 wherein said filtering is performed by means of a tuned cavity which resonates at the frequency of said transmitted microwave signal and said mixing is performed by means of a diode detector circuit connected to said tuned cavity.

7. The method of claim 1 wherein step (a) is performed by means of an oscillator circuit connected to one end of said cable and step (c) is performed by applying said low frequehcy pulse to the other end of said cable, said low frequency pulse signal being approximately a square wave signal having a voltage above the voltage of the outer conductor of said coaxial cable approximately one-half of the time and having a voltage below the voltage of the outer conductor of said coaxial cable approximately the other half of the time.

8. The method of claim 1 wherein step (e) includes alternately multiplexing an amplified version of said second signal to first and second inputs of a difference amplifying circuit in synchronization with the frequency of said interrupting recited in step (c) to produce a signal representative of the envelope of said sequence of pulses of said second signal.

9. The method of claim 6 wherein in a first group including approximately half of said antennas the anodes of said diodes are connected to said first radiating elements and said resistive means are connected to said first radiating elements and in a second group including the remaining antennas, the anodes of said diodes are connected to said second radiating elements and said resistive means are connected to said second radiating elements, whereby said relatively low frequency signal alternately forward biases the diodes in the antennas of said first and second groups, respectively, to minimize changes in the voltage standing wave ratio in said cable.

10. An apparatus for detecting intrusions into a protected region, said apparatus comprising in combination:

(a) means for transmitting a continuous microwave signal along a cable bounding said protected region;

(b) means for coupling relatively small portions of said continuous microwave signal into each of a plurality of directional antennas to effect radiating microwave energy from said antennas into said protected regions;

(c) means for periodically interrupting of microwave energy that is received by radiating elements of each of said respective antennas at a frequency that is greatly lower than the frequency of said microwave signal in order to produce a first signal which is a chopped microwave signal on said cable, said cable also conducting a relatively large noise signal that is within the doppler frequency range of a moving target in said protected area;

(d) means for filtering microwave frequencies from said first signal and mixing said filtered first signal with said noise signal to produce a second signal, said second signal including a sequence of pulses that represent said first signal and are superimposed on said noise signal;

(e) means for producing a signal representative of the amplitudes of said pulses of said sequence by comparing the potentials of said second signal before and during a plurality of said pulses; and (f) means for producing an alarm signal if the signal produced in step (e) exceeds a predetermined thereshold value.

11. The apparatus of claim 10 wherein said cable coaxial cable and each of said antennas includes first and second radiating elements, each of said antennas includes a diode coupled between its first and second radiating elements, and also including means for connecting one of said first and second radiating elements to the outer conductor of said coaxial cable and also including resistive means for coupling the other of said first and radiating elements to the center conductor of said coaxial cable, said means for periodically causing said interrupting including means for applying a relatively low frequency pulse signal to said center conductor of said cable to periodically forward bias each of said diodes to thereby effectively short circuit said first and second radiating elements of each of said antennas.

12. The apparatus of claim 11 wherein said relatively low frequency pulse signal has a frequency in the range from 1 kilohertz to 100 kilohertz.

13. The apparatus of claim 10 including the means for periodically inserting a predetermined amount of attenuation in the path of said first signal to cause calibration pulses during which said first signal has reduced amplitude to appear in said second signal, and automatic gain control circuit means for amplifying said second signal.to automatically compensate for variations in insertion loss due to use of various lengths of said cable and various numbers of said antennas loosely coupled thereto which may be utilized to bound various sized protected regions.

14. The apparatus of claim 13 including means for integrating any changes in the amplitude of said signal representative of the amplitudes of said pulses, if the frequency of those changes are very slow compared to any doppler frequency signals produced by said moving target in order to produce a cancellation voltage signal and in response thereto producing a cancellation signal component as a conductor conducting said first signal and said noise signal prior to said filtering and said mixing.

15. The apparatus of claim 14 including control means for causing said calibration pulses and said cancellation signal component to be produced at different times by multiplexing a first reference voltage and said cancellation voltage signal to a control input of a voltage controlled attenuator.

16. The apparatus of claim 10 wherein said filtering means includes a tuned cavity which resonates at the frequency of said transmitted microwave signal and said mixing means includes a diode detector circuit connected to said tuned cavity.

17. The apparatus of claim 11 wherein said transmitting means includes an oscillator circuit connected to one end of said cable and said periodic interrupting means is performed by applying said low frequency pulse to the other end of said cable, said low frequency pulse signal being approximately a square wave signal having a voltage above the voltage of the outer conductor of said coaxial cable approximately one-half of the time and having a voltage below the voltage of the outer conductor of said coaxial cable approximately the other half of the time.

18. The apparatus of claim 1 wherein said means for producing a signal representative of said amplitudes includes means for alternately multiplexing an an amplified version of said second signal to first and second inputs of a difference amplifying circuit in synchronization with the frequency of said interrupting to produce a signal representative of the envelope of said sequence of pulses of said second signal.

* * * * *